United States Patent [19]

Jarnot

[11] 4,184,414

[45] Jan. 22, 1980

[54] FLEXIBLE COVER VENT

[75] Inventor: Frank R. Jarnot, Huntington, Conn.

[73] Assignee: Airlette Corporation, Pekin, Ind.

[21] Appl. No.: 876,039

[22] Filed: Feb. 8, 1978

[51] Int. Cl.[2] ..... F24F 7/00

[52] U.S. Cl. ..... 98/37; 98/42 R; 98/2.14

[58] Field of Search ..... 137/219; 52/198, 199; 220/306; 98/37, 13, 64, 114, 42 A, 42 R, 2.14, 2.18

[56] References Cited

U.S. PATENT DOCUMENTS

| | | | |
|---|---|---|---|
| 1,606,410 | 11/1926 | Frame | 98/2.14 |
| 2,709,402 | 5/1955 | Malm | 98/37 |
| 2,804,006 | 8/1957 | Shatkin | 98/37 |
| 3,012,812 | 12/1961 | Miller, Jr. | 98/2.18 |
| 3,031,943 | 5/1962 | Steiner | 98/13 |
| 3,062,125 | 11/1962 | Henneberger | 98/42 |
| 3,892,169 | 7/1975 | Jannot | 98/37 |
| 4,050,363 | 9/1977 | Fuerst | 98/37 |

*Primary Examiner*—Henry C. Yuen

*Attorney, Agent, or Firm*—Clarence A. O'Brien; Harvey B. Jacobson

[57] ABSTRACT

First and second members are provided and include central registered openings formed therethrough. The first and second members are positionable on opposite sides of a panel having a vent opening formed therethrough of a size and shape complementary to and registered with the openings in the first and second members. Connecting structure is connected between the members securing the latter together for frictionally gripping the panel therebetween and the first member defines a tubular member and includes a cup-shaped cover having closed and open ends supported therefrom in position loosely embracing the end of the tubular member remote from the second member. A transverse baffle is supported within the cover spaced between the closed end thereof and the adjacent end of the tubular member and a sleeve member is telescoped within the tubular member and is longitudinally shiftable therein between extended and retracted positions relative to the end of the tubular member adjacent the baffle and displaced toward and away from, respectively, a position abutted against the side of the baffle opposing the adjacent end of the tubular member. Further, the closed end of the cover has air passage openings formed therethrough registered with the baffle.

12 Claims, 6 Drawing Figures

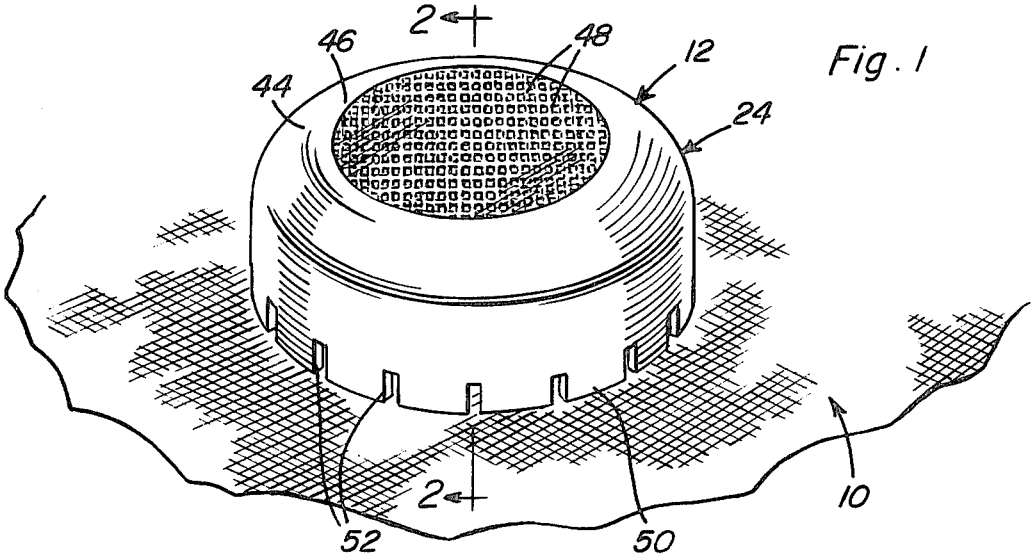
Fig. 1
Fig. 2
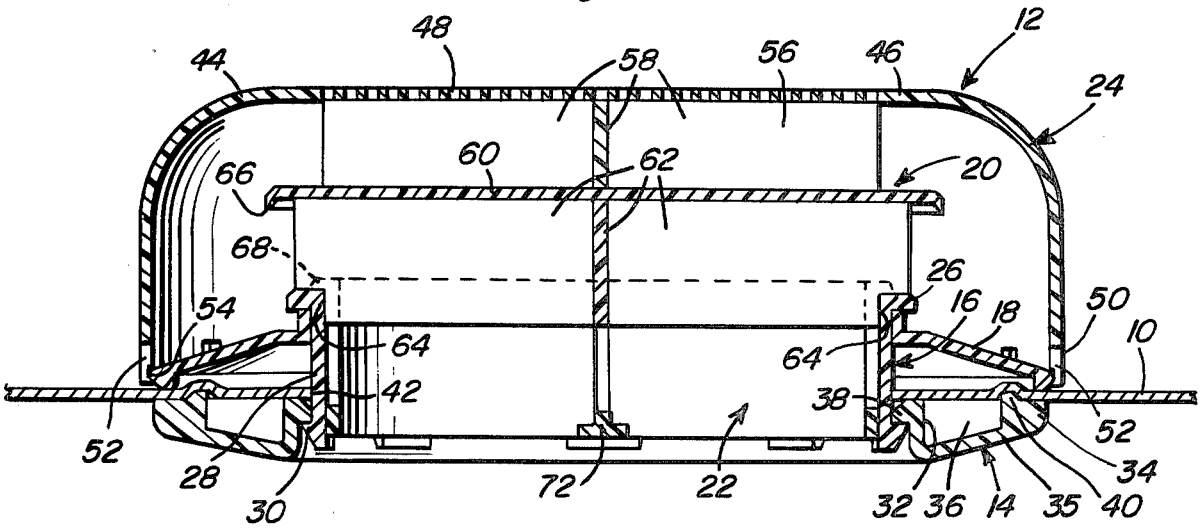
Fig. 3
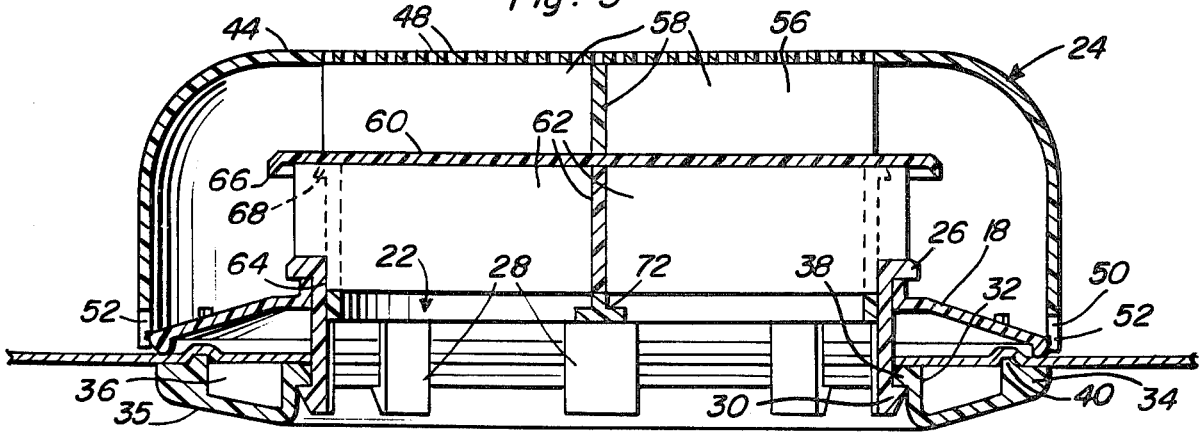

FLEXIBLE COVER VENT

BACKGROUND OF THE INVENTION

The flexible cover vent of the instant invention comprises an improvement over the vent disclosed in my prior U.S. patent No. 3,892,169. The improved vent includes a cover therefor through which ventilation air may pass and which is utilized in conjunction with a baffle within the cover to prevent the passage of rain water through the ventilation opening defined by the vent. In addition, the interior portion of the vent includes a readily shiftable closure element whereby the vent may be readily closed and opened to the passage of ventilation air therethrough from the interior of a cover upon which the vent is mounted. Further, the vent includes water drainage openings in the cover portion thereof whereby rain water passing into the interior of the vent through the cover thereof may be drained from within the interior of the vent over the exterior of the cover through which the vent is secured.

BRIEF DESCRIPTION OF THE INVENTION

The cover vent of the instant invention is constructed in a manner whereby it may be readily installed on a flexible cover panel of substantially any type without the use of tools. In addition, the vent may be installed by inexperienced persons with little effort and in a manner as to maintain the cover panel substantially waterproof. Also, the vent includes structure whereby it may be effectively closed to the passage of ventilation air therethrough from the interior of the cover panel and the closure portion of the vent is enclosed entirely within the confines of the vent.

The main object of this invention is to provide a readily installable vent for a flexible cover panel.

Another object of this invention is to provide a vent which may be installed without the utilization of tools.

Still another object of this invention is to provide a vent constructed in a manner whereby the ventilation air passage defined therethrough will be shielded against the passage of rain water therethrough.

Yet another object of this invention is to provide a vent including a screen-type cover portion therefor whereby the passage of insects therethrough will be prevented.

A still further object of this invention is to provide a vent in accordance with the preceding objects and including a closure member therefrom shiftable between open and closed positions for opening and closing, respectively, the ventilation air passage defined therethrough and with the closure member supported entirely within the confines of the cover vent.

A final object of this invention to be specifically enumerated herein is to provide a vent for flexible cover panels and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of a flexible cover with a cover vent assembly constructed in accordance with the present invention operatively associated therewith;

FIG. 2 is an enlarged fragmentary vertical sectional view taken substantially upon the plane indicated by the section line 2—2 of FIG. 1 and with the closure member in a full open position;

FIG. 3 is a vertical sectional view similar to FIG. 2 but with the closure member in a fully closed position;

DETAILED DESCRIPTION OF THE INVENTION

Figure 4:
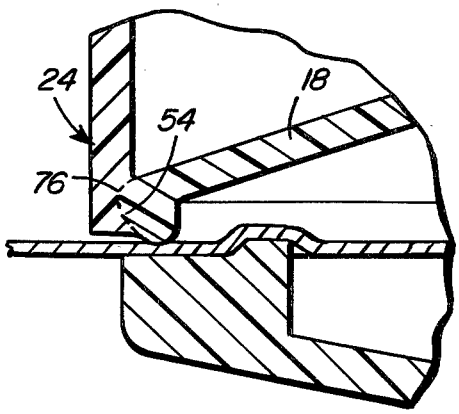
FIG. 4 is an enlarged fragmentary vertical sectional view of one peripheral portion of the vent illustrating the manner in which two components thereof may be integrally joined as an alternate means of assembly.
Figure 5:
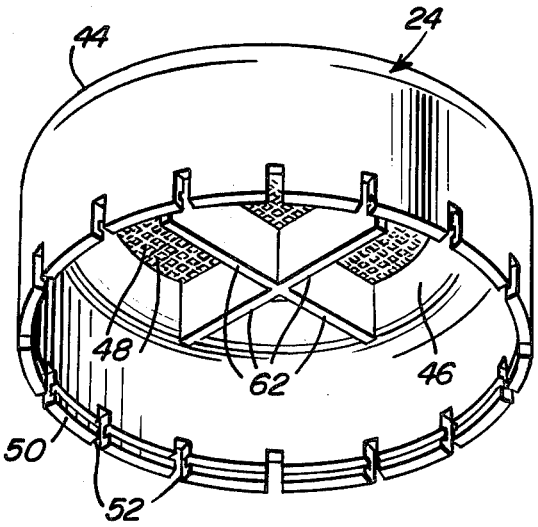
FIG. 5 is an enlarged perspective view of the cover portion of the vent as seen from the underside thereof.
Figure 6:
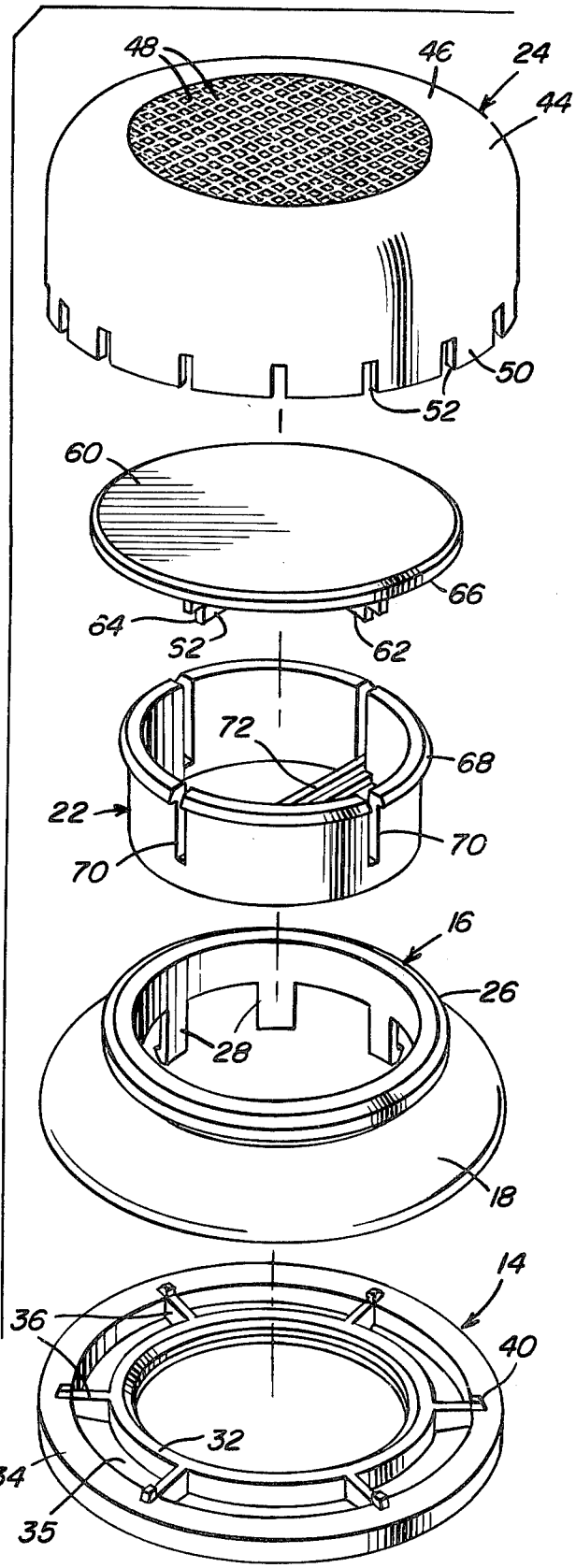
FIG. 6 is an exploded perspective view of the cover vent.

Referring now more specifically to the drawings the numeral 10 generally designates a flexible cover panel which may be constructed of canvas, plastic, nylon or any other suitable flexible material. The cover vent of the instant invention is referred to in general by the reference numeral 12 and includes an annular backing frame or member referred to in general by the reference numeral 14, a tubular body referred to in general by the reference numeral 16 including an annular washer 18 supported therefrom, a baffle assembly referred to in general by the reference numeral 20 supported from the body 16, a tubular closure member referred to in general by the reference numeral 22 telescoped in and reciprocal relative to the tubular body 16 and a cup-shaped cover referred to in general by the reference numeral 24.

The tubular body 16 is substantially cylindrical in configuration and includes a radially outwardly projecting abutment flange 26 on its outer end and a plurality of circumferentially spaced endwise outwardly projecting elongated arms 28 on its inner end. The arms 28 include free end portions having bevelled laterally outwardly projecting abutment members 30 supported therefrom and the abutment members 30 define abutment surfaces opposing the adjacent end of the abutment flange 26.

The backing frame or member 24 includes an inner annular portion 32 and an outer annular portion 34 interconnected by means of a web 35 extending therebetween and reinforced by a plurality of circumferentially spaced and generally radially extending ribs 36 extending between and interconnecting the inner and outer annular portions 32 and 34 and the inner periphery of the inner annular portion includes a radially inwardly directed bevelled abutment flange 38. It may be seen from FIGS. 2 and 3 of the drawings that the free ends of the arms 28 are inwardly deflectable and projectible through the inner annular portion 32 to a position with the abutment members 30 engaged over the side of the abutment flange 38 remote from the cover 24.

The washer 18 comprises an annular member snugly telescoped over the tubular body 16 by radial inward displacement of the free ends of the arms 28 whereby the free arm ends may be received through the inner periphery of the washer 18 and the washer 18 is thus held captive between the abutment flange 26 and the abutment members 30 carried by the free ends of the arms 28.

The outer annular portion 34 includes circumferentially spaced axially projecting detents 40 in alignment with the outer ends of the ribs 36. When the tubular body 16 has its arms 28 projected through the inner annular portion 32 of the member 14 from one side of the cover panel 10 while the member 14 is disposed on the other side of the cover panel 10 in alignment with an opening 42 formed through the cover panel 10, the outer peripheries of the washer 18 and member 14 clampingly engage the cover panel 10 therebetween with the washer 18 slightly flexed to insure that the cover panel 10 is clamped between the washer 18 and the member 14. In addition, the detents 40 are operative to frictionally engage the cover panel 10 inwardly of the annular area thereof clampingly gripped between the outer peripheries of the washer 18 and the member 14 to thereby resist angular displacement of the cover vent 12 relative to the panel 10.

The washer 18 may be formed separately from the tubular body 16, as a component separate therefrom and subsequently assembled thereon with the washer 18 shiftable on the tubular body 16 between the abutment flange 26 and the abutment members 30, or the washer 18 may be formed separately from the tubular body 16, subsequently assembled thereon and secured in operative position in any convenient manner such as by sonic welding or other suitable means.

The cover 24 includes a closed end 44 defined by an end wall 46 having air passage openings 48 formed therethrough and an open end 50 notched about its periphery as at 52. The open end 50 of the cover 24 loosely embraces the outer end of the tubular body 16 and includes an inwardly opening peripheral groove 54 in which the outer periphery of the washer 18 is removably snap engaged. Thus, the cover 24 is removably supported from the washer 18.

The inner surface of the end wall 46 includes a cruciform abutment structure 56 including four integral right angularly disposed radial flanges 58 which project from the inner surface of the end wall 46 toward the open end 50 of the cup shaped cover 40. A circular baffle 60 is disposed immediately inwardly of and abutted against the free edges of the flanges 58 opposing the adjacent end of the tubular member 16 and the baffle 60 includes similar integral right angularly disposed radial flanges 62 whose remote corner portions are notched as at 64 and seated against the outer end of the tubular body 16. The flanges 62 project inwardly of the outer end of the tubular body 16 and are therefore supported against displacement of the baffle 60 laterally of the center axis of the tubular body 16, the baffle 60 and the flanges 62 comprising the baffle assembly 20. Further, the outer periphery of the baffle 60 includes a drip lip 66 extending thereabout. Also, it will be noted that the air passages 48 formed through the end wall 46 are arranged in a circular pattern concentric with the circular baffle 60 and of a diameter considerably less than the diameter of the baffle 60.

The tubular closure member is telescoped within the tubular body 16 and includes an outer end outwardly projecting peripheral abutment flange 68 extending thereabout and engageable with the outer end of the tubular body 16 to limit inward shifting of the tubular closure member 22 relative to the tubular body 16. In addition, the tubular closure member 22 includes radial slots 70 formed therein at 90° integrals spaced thereabout and the slots 70 extend axially of the tubular closure member 22 and open through the outer end thereof as well as the flange 68. The slots, however, are closed adjacent the inner end of the tubular closure member and the latter includes a diametric brace 72 secured across its inner end.

With attention invited to FIGS. 2 and 3 of the drawings, it may be seen that the tubular closure member 22 is shiftable from the inwardly displaced open position thereof illustrated in FIG. 2 of the drawings with the outer end of the tubular closure member 22 spaced inwardly of the baffle 60 to an outermost closed limit position abutted against the inner surface of the baffle 60. The flanges 62 of the baffle assembly 20 are slidably received within the slots 70 and the tubular closure member is thereby guidingly engaged with the baffle assembly 20.

The cover 24 prevents outward displacement of the baffle assembly 20 relative to the tubular body 16 and it may therefore been seen that the tubular closure member 22 is mounted within the confines of the cover vent 12 for shifting between the open position illustrated in FIG. 2 and the closed position illustrated in FIG. 3.

Further, it may be seen that the washer 18 is inclined toward the open end 50 of the cover 24. In this manner, rain water falling through the air passages 48 and onto the upper surface of the baffle 60 may drain from the outer peripheral portion of the baffle 60 including the drip lip 66 and fall downwardly onto the upper surfaces of the washer 18 for passage downwardly therealong toward and through the drainage slots 52.

With attention now invited more specifically to FIG. 4 of the drawings, it may be seen that the outer periphery of the washer 18 may be sonic welded as at 76 within the groove 54 whereby the cover assembly 24 and washer 18 will comprise an integral component.

All of the components of the cover vent 12 may be conveniently constructed of any suitable form of plastic enabling the various components to be readily molded. Further, it will be seen that the brace 72 is readily finger engageable from the inner side of the cover panel 10 and that the tubular closure member 22 may be readily shifted between the open and closed position thereof from within the cover 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A vent for a panel, said vent comprising first and second members, said members defining central registered openings formed therethrough and being adapted to oppose the inner and outer surfaces of a panel having a vent opening formed therethrough of a size and shape complementary to and registered with said registered openings, connecting means connected between said members securing the latter together for frictionally gripping said panel therebetween, said connecting means defining a tubular member having first and second ends from which said first and second members are supported, a cup-shaped cover having closed and open ends and supported from said first member in position loosely embracing said first end of a said tubular member, a transverse baffle supported within said cover spaced between said closed end and said first end of said tubular member and a sleeve member telescoped within said tubular member and longitudinally shiftable therein between extended and retracted positions relative to said first end of said tubular member for displacement toward and away from, respectively, a position abutted against the side of said baffle opposing said first end of said tubular member, said closed end of said cover having air passage openings formed therethrough registered with said baffle.

2. The combination of claim 1 wherein said tubular member includes a radially outwardly projecting and peripherally extending flanges for abutting engagement with the side of said panel remote from said second member.

3. The combination of claim 2 wherein the end of said tubular member remote from said baffle includes peripherally spaced stiff but slightly flexible and resilient endwise outwardly projecting arms having outer free end laterally outwardly projecting end abutments, said free ends of said arms projecting through the opening in said second member and said abutments engaging the surfaces of the side of said second member remote from said flange at points spaced about the last mentioned opening.

4. The combination of claim 3 wherein said flange comprises an annular member removably mounted on the exterior of said tubular member.

5. The combination of claim 4 wherein said flange is outwardly inclined toward said second member.

6. The combination of claim 1 wherein said tubular member includes a radially outwardly projecting and peripherally extending flange for abutting engagement with the side of said panel remote from said second member, said flange being outwardly inclined toward said second member, said open end of said cover being supported from the outer periphery of said flange.

7. The combination of claim 6 wherein said open end of said cover is removably supported from and clampingly engages the outer periphery of said flange.

8. The combination of claim 6 wherein said open end of said cover embracingly receives the outer periphery of said flange therein and is secured to the latter.

9. The combination of claim 6 wherein said open end of said cover encloses the outer periphery of said flange, said cover including peripherally spaced openings formed therethrough with which said outer periphery is registered, said openings including portions thereof on the side of said flange opposing the closed end of said cover.

10. A vent for a panel having an opening formed therethrough, said vent including a tubular member for lengthwise disposition through said opening and having first and second opposite ends, said tubular member including a radially outwardly projecting circumferential flange supported from said first end and adapted to bear and seal against one side of said panel about said opening, a peripherally closed cup-shaped cover including a closed outer end and an open inner end, said cover being supported from said flange with the open inner end of said cover engaged with the outer periphery of said flange and the inner surface of the closed outer end of said cover opposing said flange and spaced axially from said first end of said tubular member, said closed outer end being defined by an end wall aligned with and disposed generally normal to said tubular member, said end wall having air passage openings formed therethrough, a baffle mounted in said cover between and in spaced juxtaposition relation to the inner surface of said end wall and said first end of said tubular member, a vent closing sleeve telescoped within said tubular member and longitudinally shiftable relative thereto between extended and retracted closed and open positions relative to said tubular member first end with the end of said sleeve corresponding to said first end of said tubular member engaged with and retracted away from, respectively, the side of said baffle opposing said first end of said tubular member.

11. The combination of claim 10 wherein the air passage openings are confined to an area of said end wall registered with a portion of the area of said baffle spaced inwardly of the outer periphery thereof and the outer periphery of said baffle projects outwardly beyond all peripheral portions of the interior of the adjacent end of said tubular member.

12. The combination of claim 11 wherein said flange is inclined outwardly away from the closed outer end of said cover, the outer periphery of said flange being received within the open inner end of said cover, said open inner end of said cover having peripherally spaced openings formed therethrough with which said outer periphery is registered, said openings including portions thereof on the side of said flange opposing the inner surface of the closed outer end of said cover.

* * * * *